United States Patent [19]

Coxhill

[11] 4,027,825

[45] June 7, 1977

[54] GYRATORY CRUSHER ECCENTRIC ASSEMBLY REMOVAL SYSTEM

[75] Inventor: Major Coxhill, Appleton, Wis.

[73] Assignee: Allis-Chalmers Corporation, Milwaukee, Wis.

[22] Filed: June 8, 1976

[21] Appl. No.: 693,781

[52] U.S. Cl. ..... 241/213; 241/215

[51] Int. Cl.[2] ..... B02C 2/06

[58] Field of Search ..... 241/37.5, 207–216

[56] References Cited

UNITED STATES PATENTS

| | | | |
|---|---|---|---|
| 2,787,424 | 4/1957 | Lippmann | 241/216 |
| 2,833,486 | 5/1958 | MacLeod | 241/216 X |
| 3,133,707 | 5/1964 | Zimmerman | 241/213 X |
| 3,140,834 | 7/1964 | Symons | 241/216 |
| 3,539,119 | 11/1970 | Cook | 241/215 |

*Primary Examiner*—Roy Lake
*Assistant Examiner*—Howard N. Goldberg
*Attorney, Agent, or Firm*—Robert C. Jones

[57] ABSTRACT

Eccentric assembly removal is accomplished by operation of the crusher head shaft piston exerting an upward pushing force on the eccentric assembly and simultaneously applying high pressure fluid to the eccentric outer bearing housing.

9 Claims, 2 Drawing Figures

GYRATORY CRUSHER ECCENTRIC ASSEMBLY REMOVAL SYSTEM

BACKGROUND OF THE INVENTION

A gyratory crusher of the type herein set forth has a central upright shaft that supports a crushing head but camming action to gyrate the head in a crushing chamber is provided by rotating an eccentric sleeve mounted around the lower end of the shaft. Such crushers are often provided with a piston beneath the central shaft, operable by fluid pressure to move vertically relative to the frame to raise and lower the shaft within the eccentric camming sleeve, and adjust the spacing between the head carried by the shaft and the concave carried by the frame. Examples of such crushers are shown in U.S. Pat. Nos. 2,448,936 of 1948; 2,579,516 of 1951; 2,667,309 of 1954; 3,372,881 of 1968; and 3,467,322 and 3,481,548 of 1969.

Crushers having the rotating eccentric sleeves are often made with hydraulic arrangements for lifting the concave member relative to a shaft and head that are not moved up or down for adjusting purposes. Examples of such crushers are U.S. Pat. No. 2,680,571 of 1954 and my own U.S. Pat. No. 3,396,916 of 1968.

However, removal of the eccentric bearing assembly requires that the entire eccentric assembly be removed. To remove the assembly, an upward evenly distributed lifting force must be applied to the assembly to effect its removal. It canbe seen that a satisfactory purchase with a chain or wire loop sling is very difficult to obtain on the assembly. If a satisfactory purchase could be obtained and the lifting force applied by an overhead crane, upon release of the assembly dangerous situations may result. One such situation is that due to the sudden release of the bearing fit, the tension in the sling and crane is suddenly released. This can cause the eccentric assembly to release suddenly thereby endangering equipment and more seriously cause bodily injury to personnel. Another dangerous situation relates to the sling itself. Because of the difficulty of obtaining a satisfactory purchase, the sling could slip loose causing damage and/or injury.

SUMMARY OF THE INVENTION

The present invention includes among its objects an improved means for removing the eccentric assembly from a gyratory crusher which is positive and safe in operation.

According to the present invention, a plurality of eccentric pushing sector plates are secured to the crusher shaft support piston. Hydraulic pressure is applied to the piston so that the piston applies, through the eccentric pushing sector plates, an upwardly acting force on the eccentric assembly. Simultaneously with the operation of the crusher shaft piston, fluid under high pressure is injected to the eccentric outer bearing housing around the bearing. The combination of the steady pushing force on the bottom of the eccentric and the injection of the fluid around the bearing will effect the gradual outward movement of the eccentric assembly from its housing. With the improvement, a safe and smooth eccentric assembly removal means is provided and one that can be accomplished with only a single operator.

Other features and objects of the invention that have been attained will appear from the following detailed description taken in conjunction with the accompanying drawing.

DESCRIPTION OF THE INVENTION

Figure 1:
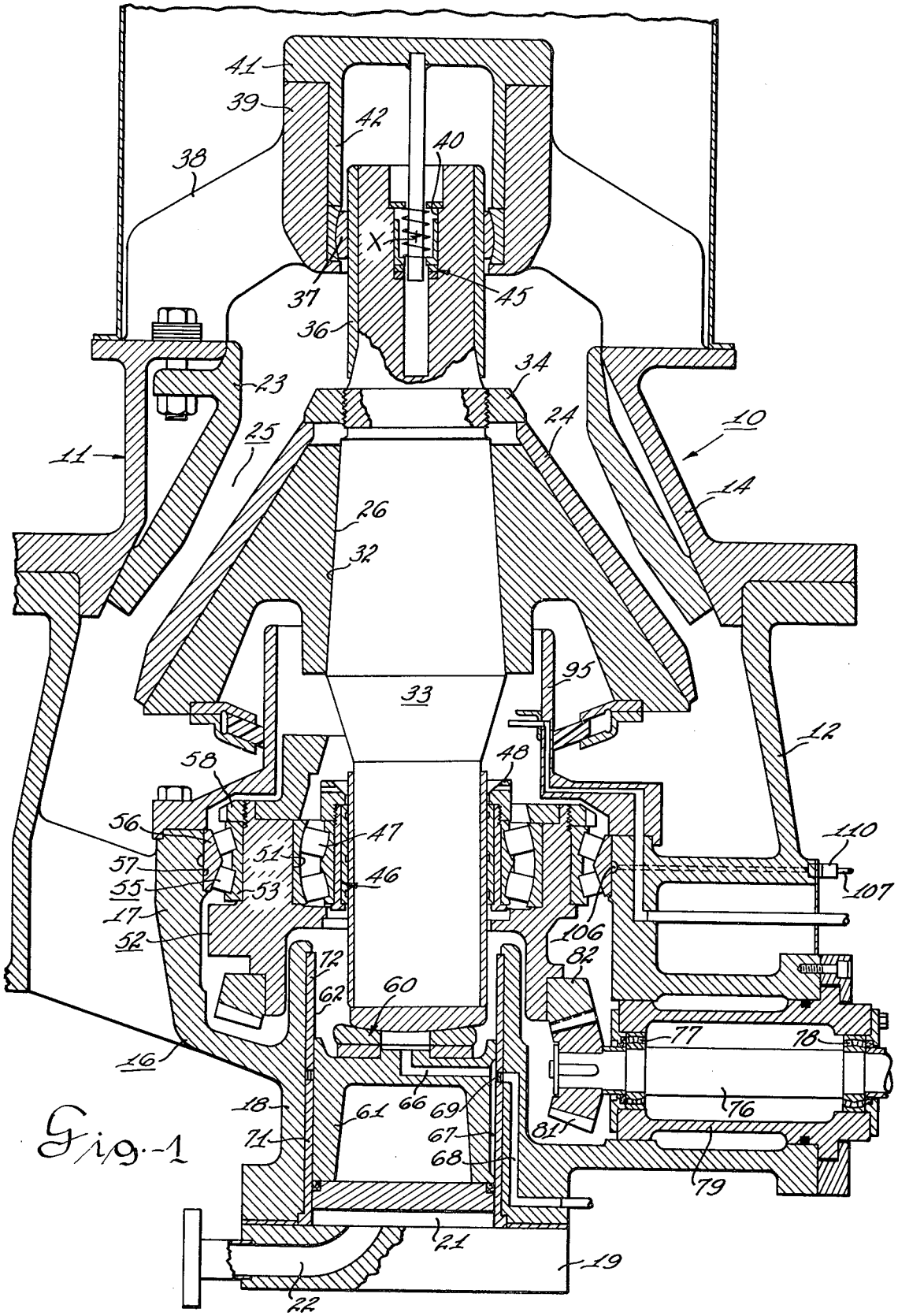
FIG. 1 is a view in vertical section of a gyratory crusher embodying the improvement for removing the eccentric assembly; and, FIG. 2 is a fragmentary view in vertical section of a portion of the gyratory crusher in which the eccentric asembly is housed with a schematic showing of the hydraulic circuit usable with the apparatus of FIG. 1, along with an eccentric removal hydraulic equipment package adapted to be quickly connected to the hydraulic circuit of the crusher.

Referring to FIG. 1 of the drawing, there is shown a gyratory crusher 10 having a frame generally indicated at 11 and including a lower frame section 12 and an upper frame section 14. The lower frame section 12 includes a fixed vertical hub 16 having an upper portion 17 and a lower portion 18. The lower hub portion 18 is provided with a closure plate 19 which forms sealed chamber 21. The closure plate 19 also provides for a hydraulic fluid inlet 22 which communicates with expansible chamber 21.

The upper frame section 14 opens upwardly and has secured therein a concave ring 23 which is supported in coaxial relationship above the hub 16. A generally conical crushing head 24 projects upwardly within the concave ring 23 to define therebetween a crushing chamber 25. The crushing head 24 is supported and arranged with its central axis inclined relative to and intersecting with the vertical axis of the hub 16 and concave ring 23. The axes intersect at a point X in a horizontal plane which passes through the midpoint of a bearing 37. The crushing head 24 has a central upwardly tapering bore 26 which is adapted to receive a tapered or frusto-conical portion 32 of a crusher head shaft 33.

A nut 34 is threadedly engaged on the crusher shaft 33 at a position adjacent the upper end of the crusher head 24 and serves to lock the crusher head in operative position on the shaft 33. The upper portion of the crusher head shaft 33 is fitted with a bearing sleeve 36 and received in a pivot bearing member 37. A spider 38, which is an integral part of the frame 11, presents an axial hub 39, the axis of which coincides with the axis of the frame. The hub 39 serves as a housing for the pivot bearing 37. A cap 41 having an axial extending sleeve portion 42 is secured to the outer end race of the hub 39 and locks the outer race of the pivot bearing 37 in the hub. A crusher head brake device 45 is accommodated in a suitable stepped bore 40 formed in the upper end of the crusher head shaft 33.

The lower end of the crusher head shaft 33 is provided with a bearing sleeve assembly 46 which is journalled in the inner race of a radial roller bearing 47. A nut 48 threadedly engaged on the outer member of the bearing sleeve assembly 46 is formed with an axial extending sleeve portion which abuts the inner race of the radial bearing 47 to lock it in position. The outer race of radial bearing 47 is supported in a bore 51 of a drive eccentric 52. A bearing surface formed on the exterior of the drive eccentric 52 receives the inner race 53 of a radial bearing 55. The outer race 56 of the bearing 55 is disposed in a circular seat 57 formed on the upper portion 17 of the vertical hub 16. To maintain the bearing 53 stationary within the circular seat 57, the outer race 56 of the bearing has an interference fit with the circular wall of the bearing seat 57. A nut 58 is threadedly engaged on a circular extension of the drive eccentric 52 and is disposed to abut the inner race 53 of the bearing 55.

An axial three-piece thrust bearing 60 is disposed beneath the crusher head shaft 33 between the lower axial end race thereof and a piston 61 within a cylinder 62 defined by the closure plate 19. Lubrication of the thrust bearing 60 is accomplished through a communcating oil passage 66 formed in the head of the piston 61. The passage 66 communicates with a vertical oil groove 67 in the exterior surface of the piston. Lubricating oil from a source (not shown) is supplied to the vertical groove 67 via a passage 68 that connects with the vertical groove 67 via a groove 69 formed by a gap between cylinder liners 71 and 72.

To drive the crusher, a pinion gear drive shaft 76 is journalled in bearings 77 and 78, carried by a bearing carrier 79 which is disposed within a laterally extending hub formed with the lower portion 18 of the frame hub section 16. The shaft 76 is driven by any suitable source of power. At its inner end, drive shaft 76 carries a pinion drive gear 81 that is in meshing engagement with a gear 82 connected to the drive eccentric 52. Thus, shaft 33 is free to move axially up and down within the bearing sleeve assembly 46 while still maintaining its gyratory drive connection with the drive eccentric 52.

In the operation of the crusher 10, power is applied to drive the pinion 81 and rotate the gear 82. This effects rotation of the drive eccentric 52 which rotates in an orbit about the vertical axis of the crusher. Thus, the axis of the crusher head shaft 33 is driven in a gyratory motion and transcribes a cone about the central vertical axis of the crusher. This motion provides the crushing action of head 24 in the crushing chamber 25. As the crusher head shaft 33 is driven in its gyratory motion about the central vertical axis of the crusher, crushing forces which are the result of stone being broken between the head 24 and the concave 23 develop forces which react on the head 24. These forces cause the head 24 and thereby the shaft 33 to rotate about the axis of the crusher head shaft 33 slowly in the opposite direction relative to the direction of rotation of the drive eccentric 52 while the crusher head shaft is being bodiy moved in a gyratory path of travel about the central vertical axis of the crusher.

Vertical support and positioning of the crusher head 24 for adjusting the opening of the crushing chamber 25 is accomplished by hydraulic fluid under pressure. For this purpose, hydraulic fluid under pressure is supplied to the expansible chamber 21 via the passage 22 in the closure plate 19. The fluid under pressure in chamber 21 reacts on the piston 61 elevating the shaft 33 and thereby the crusher head 24 (or lowers the assembly) as desired.

Figure 2:
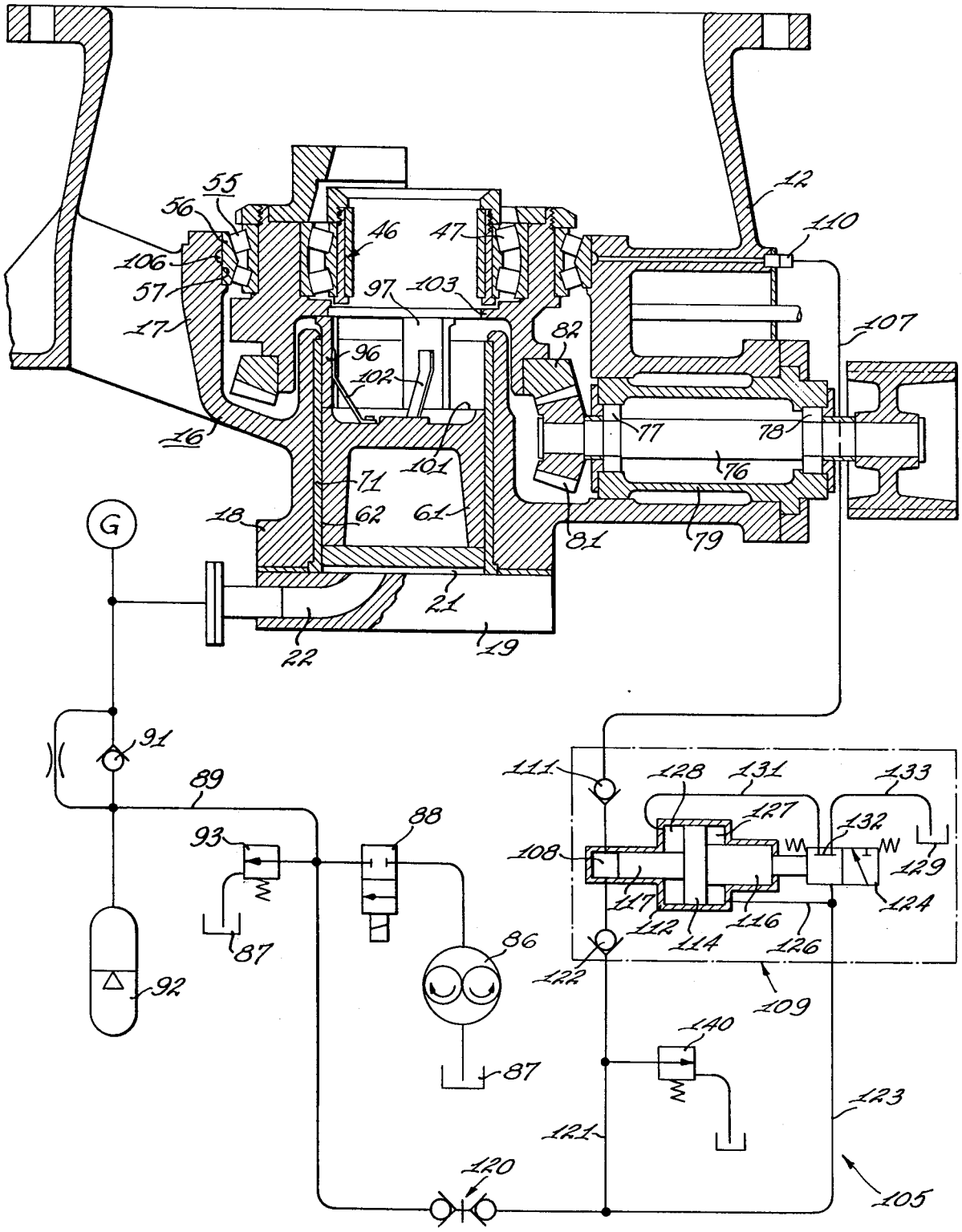

As shown in FIG. 2, fluid supply means, herein shown as a pump 86 which is connected to draw hydraulic fluid from a reservoir 87. Fluid under pressure is supplied to a solenoid-operated, normally closed, two-position distribution valve 88 which, when actuated, positions the valve spool therein to pass the fluid into a connected line 89. The opposite end of the line 89 is connected to the passage 22 in the closure plate 19. With the crusher head 24 elevated into a desired position relative to the concave 23, a pilot operated check valve 91 is operable to by-pass excess fluid into an accumulator 92. In the event that noncrushable material enters into the crusher chamber 25 the pressure in the cylinder 62 could exceed the nitrogen precharge pressure in the accumulator 92. Excessive pressure will force the fluid out of the cylinder 62 and into the fluid chamber side of the accumulator 92, thereby providing for passage of the noncrushable material through the crushing chamber 25. The system is protected by a relief valve 93.

As previously mentioned, the outer race 56 of the thrust bearing 55 has an interference fit within the bearing seat 57. To remove the bearing 55 easily and without the complication of a sling and crane arrangement, a novel arrangement is provided which utilizes the fluid under pressure from the crusher circuit described. As shown in FIG. 2, the upper frame section 14, the crusher head 24, the crusher head shaft 33 and the circular axial shield 95 are removed from the crusher. Three eccentric pushing sector plates, plates 96 and 97 being shown, are inserted into the upper end of the cylinder 62. The sector pushing plates 96 and 97, which are shown, and the third sector pushing plate (not shown) are arranged to engage on the axial end race 101 of the peripheral skirt of the piston 61. Each of the sector plates is secured in operative position by means of brackets 102 which are bolted to the top of the piston 61. Thus, the sector pushing plates 96 and 97, which are shown, and the third plate (not shown) are maintained in upright operative position to engage the bottom of a radial inwardly extending circular flange 103.

The sector pushing plates are of arcuate configuration conforming in curvature to the curvature of the wall surface of the cylinder 62. As can be seen in FIG. 2, the upper ends of the sector pushing plates are formed with an outwardly extending flange on the head portion to provide a relatively large bearing area which engages the under surface of circular flange portion 103 of the drive eccentric.

A quick-connect eccentric hydraulic removal system 105 is connected to the crusher hydraulic circuit associated with the piston 61. Thus, the hydraulic fluid under pressure in the crusher circuit is made available for injections around the housing bore in which the outer race 56 of the bearing 55 has an interference fit.

To this purpose, a circular oil groove 106 is formed in the wall of the bore 57. A small bore hose or conduit 107 is connected to supply fluid to the oil groove 106 from a pressure chamber 108 of a fluid intensifier 109 herein depicted as an all hydraulic reciprocating fluid intensifier. Connection of the relatively small bore conduit 107 is accomplished at the exterior surface of the crusher frame by means of a quick-connect connection 110. A check valve 111 built into the intensifier 109 restricts the back flow of fluid into the intensifier chamber 108. As shown, the intensifier 109 comprises a cylinder 112 in which a piston 114 is supported for reciprocal movement. The right-hand side of the piston 114, as viewed in FIG. 1, is provided with relatively large diameter piston rod 116 thereby reducing the area of the right side of the piston. The left-hand side of the piston 114 is provided with a piston rod 117, the diameter of which is smaller with respect to the diameter of the rod 116. Thus, the left race of the piston is greater in area than the area of the right race. Thus, with a connection being effected between the system 105 and the crusher hydraulic circuit via the quick-connect connection 120, fluid under pressure flows through line 121 and intensifier check valve 122 into chamber 108. The check valve 122 prevents the reverse flow of fluid from the intensifying chamber 108 when the piston 114 and thus piston 117 are moving from right to left and pressurizing fluid in that chamber. The check valve 111 prevents the reverse flow of fluid from the high pressure line 107 when the piston 114 is moving from left to right and oil is flowing into the chamber 108 via the check valve 122. Also, the flow of fluid in line 121 is directed into a connected line 123 which communicates with a normally blocked shaft of a distribution or shuttle valve 124. As a result, the fluid in line 123 is diverted into a connected line 126 which communicates with chamber 127 on the right side of piston 114. At this time, chamber 128 on the left side of piston 114 is connected to a reservoir 129 via a line 131, a U-passage 132 in valve 124 and a line 133. Thus, the fluid under pressure to the chamber 127 forces the piston and the associated rod 117 in a leftwardly direction. The leftward movement of the rod 117 acts on the fluid in the chamber 108 to intensify the pressure of the fluid therein thereby causing the check valve 111 to open. As a result, fluid under pressure flows into the oil groove 106 to lubricate the wall of the bore 57.

When piston 114 and 117 have reached their limit of leftward travel, the shuttle valve 124 changes position by means of its mechanical connection to the piston rod 116. The fluid under pressure in line 123 will be connected to the chamber 128 by means of the valve porting in its cross-over position. Thus, the larger area on the left-hand side of the piston 114 causes the piston to move rightwardly. This allows additional fluid to flow through the check valve 122 into the intensifying chamber 108.

Fluid under high pressure will be continuously pumped by the reciprocating piston rod 117 to build up the pressure in groove 106 to a maximum pressure as attained by the pressure multiplication ratio of the intensifier 109. At this point the intensifier will stop reciprocating. As leakage occurs around circular seat 57 the intensifer automatically reciprocates until pressure is again built up in the groove 106 and circular seat 57.

Included in the pressure intensifier circuit package 105 is a relief valve 140. Assuming that 375–400 P.S.I. is needed in groove 106 in order to release the bearing 55, and that the intensifier 109 has an intensifying ratio of 6.5:1, and a 60 P.S.I. will be needed in the circuit associated with the crusher 10 to elevate the shaft 33. Under these conditions the relief valve 140 should be adjustable from 0 to 200 P.S.I. The adjustability of the relief valve 140 will enable the crusher system pressure to increase until the intensifier 109 begins to cycle and bleeds the high pressure lines after being connected via quick connect coupling 120 to the crusher system. When the high pressure lines are bled and fluid has filled the groove 106, the setting of the relief valve 140 can be set to establish the pressure in the intensifier circuit to bearing removal pressure.

Simultaneously therewith, fluid under pressure is passed into chamber 21 forcing the piston 61 upwardly. As the piston 61 moves upwardly, a steady pushing force is applied to the bottom of the radially inwardly extending flange 103 through the pushing sectors plates 96, 97 and the associated third pushing sector plate (not shown). The combination of the fluid under pressure to the groove 106 and the application of a steady upwardly acting pushing force to the flange 103 will effect a gradual displacement of the drive eccentric assembly which includes the bearing 55. It is apparent that the removal of the drive eccentric assembly by the method and means herein set forth provides a facile and safe arrangement which is easily accomplished by a single operation.

The embodiments of the invention in which an exclusive property or privilege is claimed are defined as follows:

1. In a gyratory crusher having a frame defining a bearing housing, with a vertical central axis and a bottom inner axial extending lower portion defining a cylinder, an axial movable piston within the cylinder, a bearing sleeve assembly, a crusher head shaft supported for rotational and axial movement in the bearing sleeve assembly, a drive eccentric for driving the crusher head shaft in a gyratory movement about the vertical central axis, an antifriction bearing having its outer race confined with an interference fit in the bearing housing, the inner race of the antifriction bearing being engaged on the drive eccentric, a fluid circuit connected to supply fluid under pressure to the cylinder at the side of the piston remote from the end of the crusher head shaft:

a plurality of pusher plates disposed within the cylinder in position to be moved upwardly into forceful engagement with the drive eccentric upon upward movement of the piston;

fluid distribution means in the bearing housing in which the outer race of the antifriction bearing has an interference fit to distribute fluid under pressure around the outer race of the antifriction bearing; and, a fluid circuit connectible to said fluid distribution means and to the fluid circuit of the crusher to supply fluid under pressure to said fluid distribution means as fluid under pressure is supplied to the cylinder for effecting upward movement of the piston within the cylinder, whereby a mechanical upwardly acting pushing force is applied to the drive eccentric and simultaneously therewith fluid under higher pressure is injected around the race of the antifriction bearing to thereby effect a gradual easing of the antifriction bearing from the housing.

2. A gyratory crusher according to claim 1 wherein said pusher plates are disposed in direct physical contact with said piston and said drive eccentric.

3. A gyratory crusher according to claim 1 wherein said pusher plates are at least three in number and have an arcuate configuration which conforms to the curvature of the wall of the cylinder.

4. A gyratory crusher according to claim 1 wherein said fluid distribution means includes a circular groove in the wall of the bearing housing; and, fluid conduit means in communication with said groove and the exterior of said crusher;

whereby said fluid circuit may be readily connected and disconnected to said conduit means as desired.

5. A gyratory crusher according to claim 1 wherein said fluid circuit includes a pressure intensifier to effect an increase of the presure of the fluid supplied to said fluid distribution means.

6. A gyratory crusher according to claim 5 wherein said fluid circuit includes a conduit having a bore of relatively small cross-section which is connected between said fluid pressure intensifier and said fluid distribution circuit groove.

7. A gyratory crusher according to claim 5 wherein said pressure intensifier is hydraulically driven by pressure fluid from the fluid circuit associated with said crusher.

8. A gyratory crusher according to claim 7 including a fluid by-pass in said fluid circuit to pass fluid under pressure to said pressure intensifier to effect its operation, whereby the reverse flow of fluid under pressure from the fluid circuit associated with said crusher is blocked by operation of a first check valve and the fluid in said pressure intensifier is prevented from flowing therefrom by operation of a second check valve and the fluid pressure in the upstream side of said second check valve is bypassed to the operation of said pressure intensifier to effect the operation of said pressure intensifier to increase the pressure of the fluid therein so that fluid will be supplied to said fluid distribution means at a relatively high pressure level.

9. A gyratory crusher according to claim 8 wherein said pressure intensifier is continuously operable to maintain the fluid supplied to said fluid distribution means at a relatively high level.

* * * * *